US005722430A

United States Patent [19]

Bentley et al.

[11] Patent Number: 5,722,430

[45] Date of Patent: Mar. 3, 1998

[54] MONEY CLIP AND CIGAR CUTTER

[76] Inventors: Dale Bentley, 23101 Farmington Rd., Farmington, Mich. 48336; John Ginopolis, 4763 Valley View South, West Bloomfield, Mich. 48033

[21] Appl. No.: 785,899

[22] Filed: Jan. 21, 1997

[51] Int. Cl.[6] ..... A24F 9/10

[52] U.S. Cl. ..... 131/243; 131/246; 131/249

[58] Field of Search ..... 131/243, 246, 131/247, 249, 253; 273/32 B, 32 A, 32 R; 83/57, 58, 59, 66

[56] References Cited

U.S. PATENT DOCUMENTS

| | | | |
|---|---|---|---|
| 4,043,348 | 8/1977 | Kanady | 131/243 |
| 4,600,022 | 7/1986 | Pierce, Jr. | 131/243 |
| 4,625,861 | 12/1986 | Krog | 131/243 |
| 5,208,983 | 5/1993 | Masse | 131/243 |
| 5,357,653 | 10/1994 | van Ardenne | 131/243 |
| 5,377,413 | 1/1995 | Masse | 131/243 |
| 5,449,169 | 9/1995 | Hardin et al. | 273/32 B |

OTHER PUBLICATIONS

Photographs of cigar cutter taken at Georgetown Tobacco in Washington, D.C. on Nov. 30, 1996.

*Primary Examiner*—Vincent Millin
*Assistant Examiner*—Charles Anderson
*Attorney, Agent, or Firm*—Harness, Dickey & Pierce, P.L.C.

[57] ABSTRACT

A money clip and cigar cutting apparatus is provided with a housing having an opening therethrough. A cutting blade is supported by the housing such that a sharpened edge thereof traverses the opening for cutting a cigar. A money clip is pivotally attached to the housing so that the money clip can be pivoted clear of the cigar cutter. The money clip may also be detachable from the housing so that the cigar cutter can be used separately from the money clip

19 Claims, 2 Drawing Sheets

MONEY CLIP AND CIGAR CUTTER

BACKGROUND OF THE INVENTION

Field of the Invention

The present invention relates to a money clip and cigar cutter, and more particularly to a money clip having a cigar cutter which is usable without requiring the removal of the money maintained in the money clip.

BACKGROUND AND SUMMARY OF THE INVENTION

The use of cigar cutters of a wide variety of designs and configurations is known. By way of example, U.S. Pat. No. 4,625,861 issued to Krog, discloses a case for a lighter having a hole with a cutting edge on the inner side of a sidewall thereof for cutting cigar tips. The cigar cutting is carried out by pushing the lighter a short distance out of the case so that the bottom of the lighter is positioned above the hole. The tip of a cigar is inserted into the hole and the bottom of the layer is moved past the hole in such a manner that the tip of a cigar is pressed against the cutting edge of the hole and cut off.

Furthermore, the use of money clips of a wide variety of designs and configurations is also known. By way of example, U.S. Pat. No. 5,449,169 issued to Hardin et al, discloses a divot repair tool for golfers which has a housing provided with a spring clip that allows money to be positioned between the spring clip and the housing of the retractable divot repair tool.

In this respect, it is an object of the present invention to combine a cigar cutting mechanism with a money clip device.

These and other objects of the present invention are obtained by providing in combination a clip device and cutter mechanism, including a housing having an opening therethrough, a cutting blade supported in the housing and a spring clip pivotally attached to the housing. The spring clip is pivotally attached to the housing such that the spring clip can be pivoted away from the opening in the housing so as not to interfere with a cigar which is inserted in the opening for cutting. The spring clip is provided with a retaining member which preferably pivots along with the spring clip for providing a backing surface against which an arm of the spring clip is biased to provide a clamping force to maintain money in the money clip even while the spring clip is pivoted clear of the opening in the housing. The spring clip used for holding money can also be detached from the housing so that the cigar cutter can be used separately from the money clip device. In this manner, the cigar cutting device can be loaned to other cigar smokers while the money clip can be maintained by its owner without risk of loss of his money.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
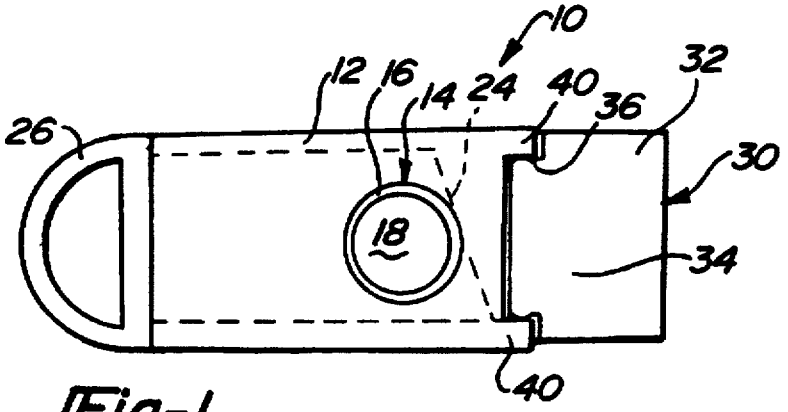
FIG. 1 is a plan view of a money clip and cigar cutter according to the principles of the present invention.
Figure 2:
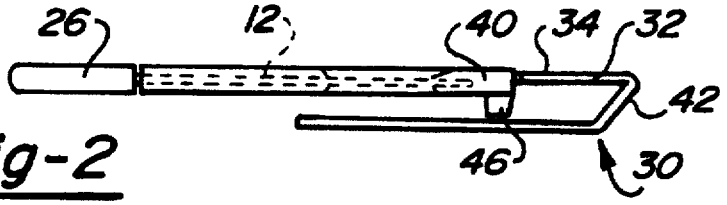
FIG. 2 is a side view of the money clip and cigar cutter shown in FIG. 1.
Figure 3:
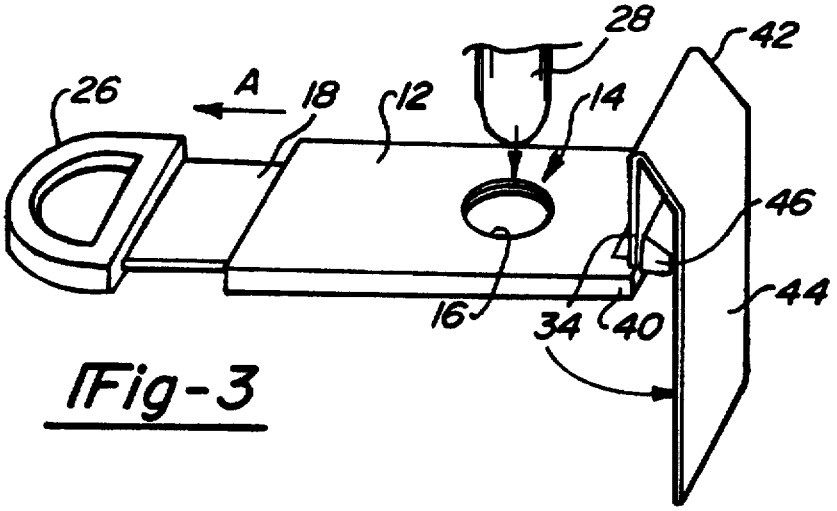
FIG. 3 is a perspective view illustrating the use of the cigar cutting device in the pivoting money clip.

With reference to FIGS. 1–4, a first embodiment of the money clip and cigar cutter of the present invention will be described. The money clip and cigar cutter 10 includes a housing 12 which houses the cigar cutter 14. The cigar cutter 14 includes an opening 16 provided in the housing 12 and a cutting blade 18 which is disposed between opposing faces 20, 22 of housing 12. Cutting blade 18 is provided with a sharpened edge 24 along a first end thereof and a handle 26 along a second end thereof.

Figure 4:
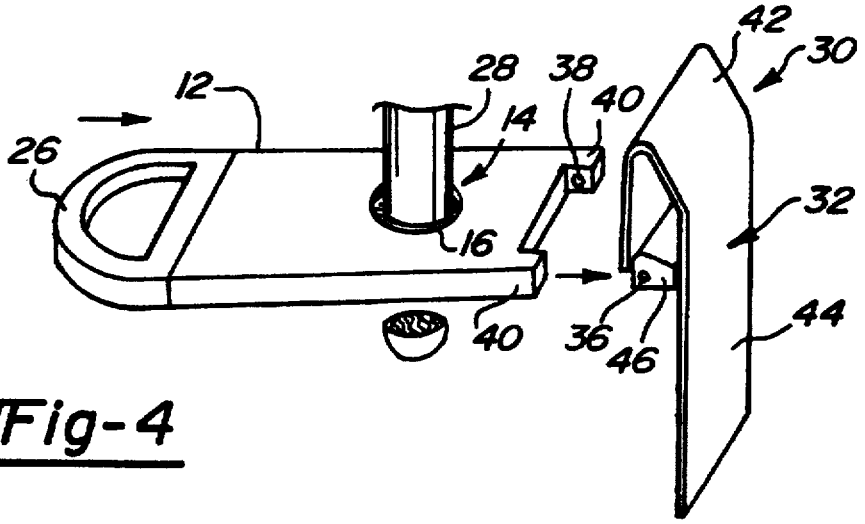
FIG. 4 is a perspective view further illustrating the operation of the cigar cutter and illustrating the detachability of the money clip from the housing.

The money clip and cigar cutter 10 is also provided with a money clip 30 which includes a spring clip 32 with a base portion 34 pivotally attached to housing 12. Base 34 is provided with a pair of protrusions 36 which engage detents 38 provided on an interior surface of housing flange portion 40. The spring clip 32 is generally J-shaped with a bend portion 42 provided along base portion 34 and an elongated arm 44 extending from bend portion 42. A retaining member 46 extends from base portion 34 toward arm 44. Arm 44 is biased against retaining member 46 so that money can be inserted between the retaining member 46 and arm 44 and the money is properly maintained therebetween by the biasing force of arm 44. Spring clip 32 is pivotable about protrusions 36 so that arm 44 can be rotated away from opening 16 in housing 12 so that there is no interference with the cigar cutter 14. In addition, spring clip 32 can be detachable from housing 12, as shown in FIG. 4, so that money clip 30 can be retained by the owner and the cigar cutter 14 can be passed around for use by others. The protrusions 36 attached to base 34 of spring clip 32 are snap-fit into detents 38 of flanges 40.

In operation as a cigar cutter, handle 26 can be engaged by a user to move the cutting blade from a first (stored) position as shown in FIGS. 1 and 4 to a second (operating) position in the direction of arrow A so that the sharpened edge 24 of cutting blade 18 clears the opening 16 so that the tip of a cigar 28 can be inserted into the opening 16. The cigar 28 is then positioned at the desired location for cutting and the handle 26 is pressed in the direction of arrow C causing the sharpened edge 24 of cutting blade 18 to traverse opening 16 thereby cutting the tip of the cigar 28, as shown in FIG. 4.

Figure 5:
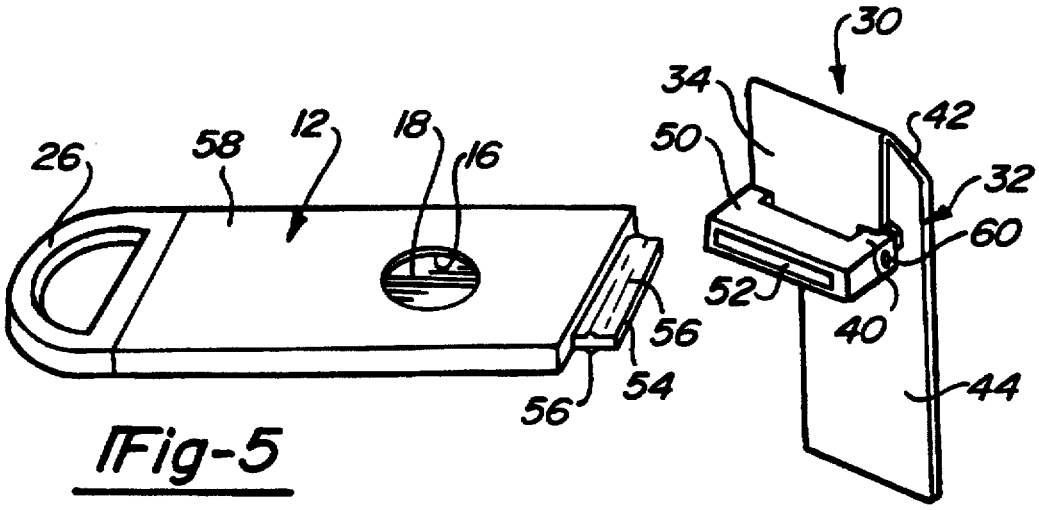
FIG. 5 is a perspective view of a money clip and cigar cutter according to another embodiment of the present invention.

With reference to FIG. 5, a second embodiment of the present invention is shown wherein like reference numerals designate the same elements. In FIG. 5, the housing 12 is provided with a detachable section 50 which is provided with an opening 52 for receiving snap element 54. Snap element 54 is provided with a pair of ribs 56 which engage with corresponding ribs (not shown) disposed within opening 52 of detachable section 50. The ribs 56 of snap element 54 engage with the ribs disposed in opening 52 to maintain detachable section 50 in connection with main housing portion 58. Spring clip 32 is pivotally attached to detachable section 50 by a pivot pin 60 which extends through openings 62 in flanges 40 of detachable section 50 and through an opening (not shown) in base portion 34 of spring clip 32. The money clip 30 of the embodiment shown in FIG. 5 is therefore pivotable with respect to housing 12 and is also removable from main housing portion 58.

Figure 6:
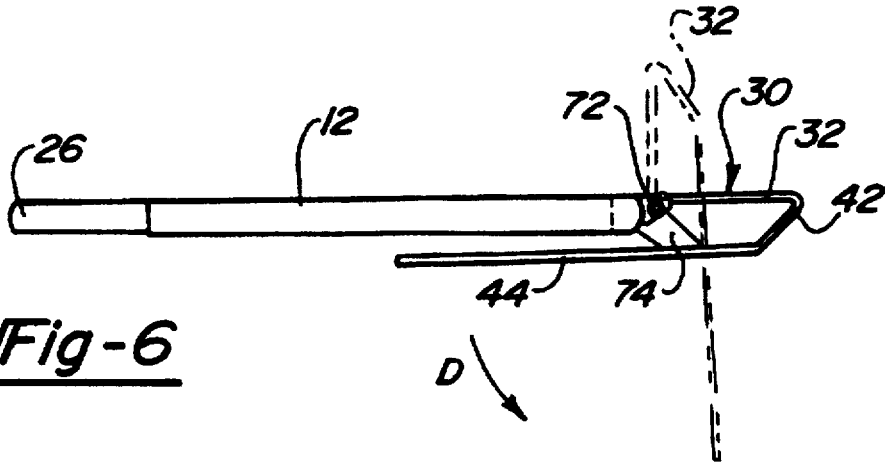
FIG. 6 is a side view of a money clip and cigar cutter according to still another embodiment of the present invention.
Figure 7:
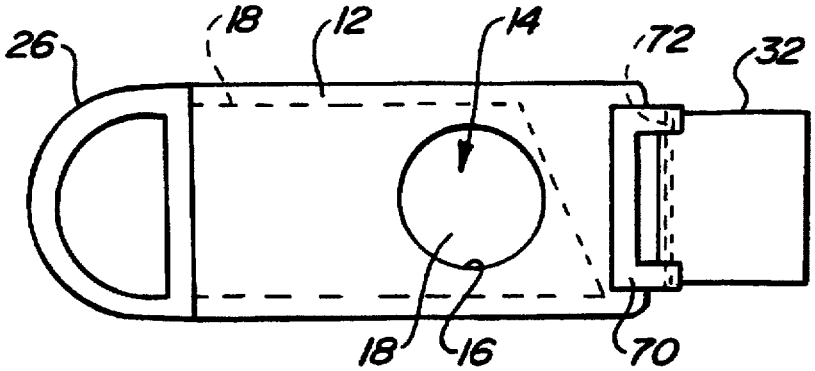
FIG. 7 is a plan view of the money clip and cigar cutter shown in FIG. 6.

With reference to FIGS. 6 and 7, a third embodiment of the money clip and cigar cutter according to the principles of the present invention will be described. In FIGS. 6 and 7, the spring clip 32 is pivotally attached to a base member 70 by a pivot pin 72. Base member 70 is provided with an extending finger 74 which maintains contact with arm 44 of spring clip 32 while spring clip 32 is pivoted about pin 72 in the direction of arrow D. Thus, the money retained in the money clip 30 will continue to be securely maintained between arm 44 and finger 74 even while the spring clip 32 is pivoted away from the opening 16 in housing 12.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In combination a money clip device and cutter mechanism, comprising:

a housing having an opening therethrough and said housing including a first connector member;

a cutting blade supported in said housing, said cutting blade movable in said housing for cutting an article in said opening; and a spring clip having a second connector member adapted to mate with said first connector member and said spring clip pivotally attached to said housing.

2. The money clip device and cutter mechanism according to claim 1, wherein said cutting blade is provided with a sharpened edge which traverses said opening in said housing.

3. The money clip device and cutter mechanism according to claim 2, further comprising a handle attached to said cutting blade.

4. The money clip device and cutter mechanism according to claim 1, wherein said spring clip is adapted to support paper money.

5. The money clip device and cutter mechanism according to claim 4, wherein said spring clip is detachable from said housing.

6. The money clip device and cutter mechanism according to claim 1, further comprising an extending finger which maintains contact with an arm of said spring clip while said spring clip is pivoted relative to said housing.

7. The money clip device and cutter mechanism according to claim 1, further comprising a base member for attaching said spring clip to said housing said base member including an extending finger which maintains contact with an arm of said spring clip while said spring clip is pivoted relative to said housing.

8. In combination a clip device and cutter mechanism, comprising:

a housing having an opening therethrough and said housing including a first connector member;

a cutting blade supported in said housing for reciprocal movement from a first position to a second position for cutting an article placed in said opening; and a spring clip having a second connector member adapted to mate with said first connector member and said spring clip removably attached to said housing.

9. The clip device and cutter mechanism according to claim 8, wherein said cutting blade is provided with a sharpened edge which traverses said opening in said housing.

10. The clip device and cutter mechanism according to claim 9, further comprising a handle attached to said cutting blade.

11. The clip device and cutter mechanism according to claim 8, wherein said spring clip is adapted to support paper money.

12. The clip device and cutter mechanism according to claim 8, further comprising an extending finger which maintains contact with an arm of said spring clip while said spring clip is pivoted relative to said housing.

13. The clip device and cutter mechanism according to claim 8, further comprising a base member for attaching said spring clip to said housing said base member including an extending finger which maintains contact with an arm of said spring clip while said spring clip is pivoted relative to said housing.

14. The clip device and cutter mechanism according to claim 8, wherein said housing includes a detachable section which supports said spring clip and main section which houses said cigar cutter.

15. In combination a clip device and cutter mechanism, comprising:

a housing having an opening therethrough and said housing including a first connecting member;

a cutting blade supported in said housing for reciprocal movement from a first position to a second position such that a sharp edge of said cutting blade traverses said opening; and a spring clip having a second connector member adapted to mate with said first connector member and said spring clip pivotally attached to said housing.

16. The clip device and cutter mechanism according to claim 15, further comprising a handle attached to said cutting blade.

17. The clip device and cutter mechanism according to claim 15, wherein said spring clip is adapted to support paper money.

18. The clip device and cutter mechanism according to claim 15, further comprising an extending finger which maintains contact with an arm of said spring clip while said spring clip is pivoted relative to said housing.

19. The clip device and cutter mechanism according to claim 15, further comprising a base member for attaching said spring clip to said housing said base member including an extending finger which maintains contact with an arm of said spring clip while said spring clip is pivoted relative to said housing.

* * * * *